US007594777B2

(12) United States Patent
Chiu

(10) Patent No.: US 7,594,777 B2
(45) Date of Patent: Sep. 29, 2009

(54) WAVY TACTILE WALK PATH

(76) Inventor: I-Cheng Chiu, 9F, No. 70, Sec. 5, Nan-King East Road, Taipei (TW)

( * ) Notice: Subject to any disclaimer, the term of this patent is extended or adjusted under 35 U.S.C. 154(b) by 0 days.

(21) Appl. No.: 11/960,534

(22) Filed: Dec. 19, 2007

(65) Prior Publication Data

US 2009/0162143 A1 Jun. 25, 2009

(51) Int. Cl.
*E01C 13/04* (2006.01)

(52) U.S. Cl. ..... 404/35; 404/41; 273/DIG. 31

(58) Field of Classification Search ..... 404/19, 404/34, 35, 41, 42; 273/DIG. 31; 104/63
See application file for complete search history.

(56) References Cited

U.S. PATENT DOCUMENTS 363,353 A * 5/1887 Baker ..... 112/428
888,530 A * 5/1908 Pugh ..... 52/311.2
2,680,698 A * 6/1954 Schnee ..... 404/35
3,229,439 A * 1/1966 Strobel ..... 52/591.2
4,925,338 A * 5/1990 Kapusta ..... 404/41
5,211,895 A * 5/1993 Jacklich, Sr. ..... 264/71
6,328,500 B1 * 12/2001 Rubio ..... 404/32
6,705,797 B1 * 3/2004 Wada ..... 404/38
6,722,814 B2 * 4/2004 Byrne ..... 404/35

FOREIGN PATENT DOCUMENTS

DE 31 12 608 * 10/1982
FR 2 705 700 * 12/1994

* cited by examiner

*Primary Examiner*—Gary S Hartmann
(74) *Attorney, Agent, or Firm*—Pro-Techtor Int'l Services; Ralph Willgohs

(57) ABSTRACT

The present invention provides a pattern-changing walk path on top of which some groove lines and some raised ridges or dots form an anti-skidding layer for children's play and games. The modular design may be disassembled into the units for storage, taking up little room since they can be stacked together, and can be securely attached to one another when put together for use.

6 Claims, 3 Drawing Sheets

WAVY TACTILE WALK PATH

FIELD AND BACKGROUND OF THE INVENTION

The present invention relates generally to a design and construction of a modular wavy tactile path and its building block, enabling children to learn better balancing technique in their physical development.

As urban development takes up more space, today's children are put in more city-oriented environment where walkways are made flat and level, and hurdles and potential hazards are removed. There is less chance for them to learn to balance themselves while walking on uneven or treacherous surfaces. With this invention, children will learn to develop the ability to respond and adapt quickly to changing environment around them.

In light of the above-said situation, present invention provides for the construction of a wavy tactile path that can be made from modular units to form a wavy, uneven, sliding and slanting walk way that is fun for kids to walk on, like a "cliff", while learning to balance themselves, thus enhancing their ability to quickly respond and adapt to environment that is less than ideal.

OBJECTS AND SUMMARY OF THE INVENTION

Present invention allows the creation of a fun, creative and wavy tactile walk way based upon modular units that can be stacked up for storage in small volume and can be used for connected with one another, making left-turn, right-turn or a full-circle shape, for children to balance themselves while walking on the path.

An object of present invention is to provide a walk path on top of which some groove lines and some raised ridges are a part of the surface for kids to walk on, so that kids can feel the touch of these uneven features with the bottom of their bare feet, helping to calm down kids' emotional states and make learning activities more interesting.

These groove lines or raised edges serve as anti-skidding layer to increase the friction between the bottom of children's feet and the walk path surface. Alternatively, The anti-skidding layer can be made in the shape of raised dots or caved-in dots spread on the surface of such walk path.

A further object of present invention is to allow the construction of such wavy tactile using modular units, so that it is easy to disassemble the units for storage (taking up little room since they can be stacked together) and can be securely attached to one another when put together for use.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
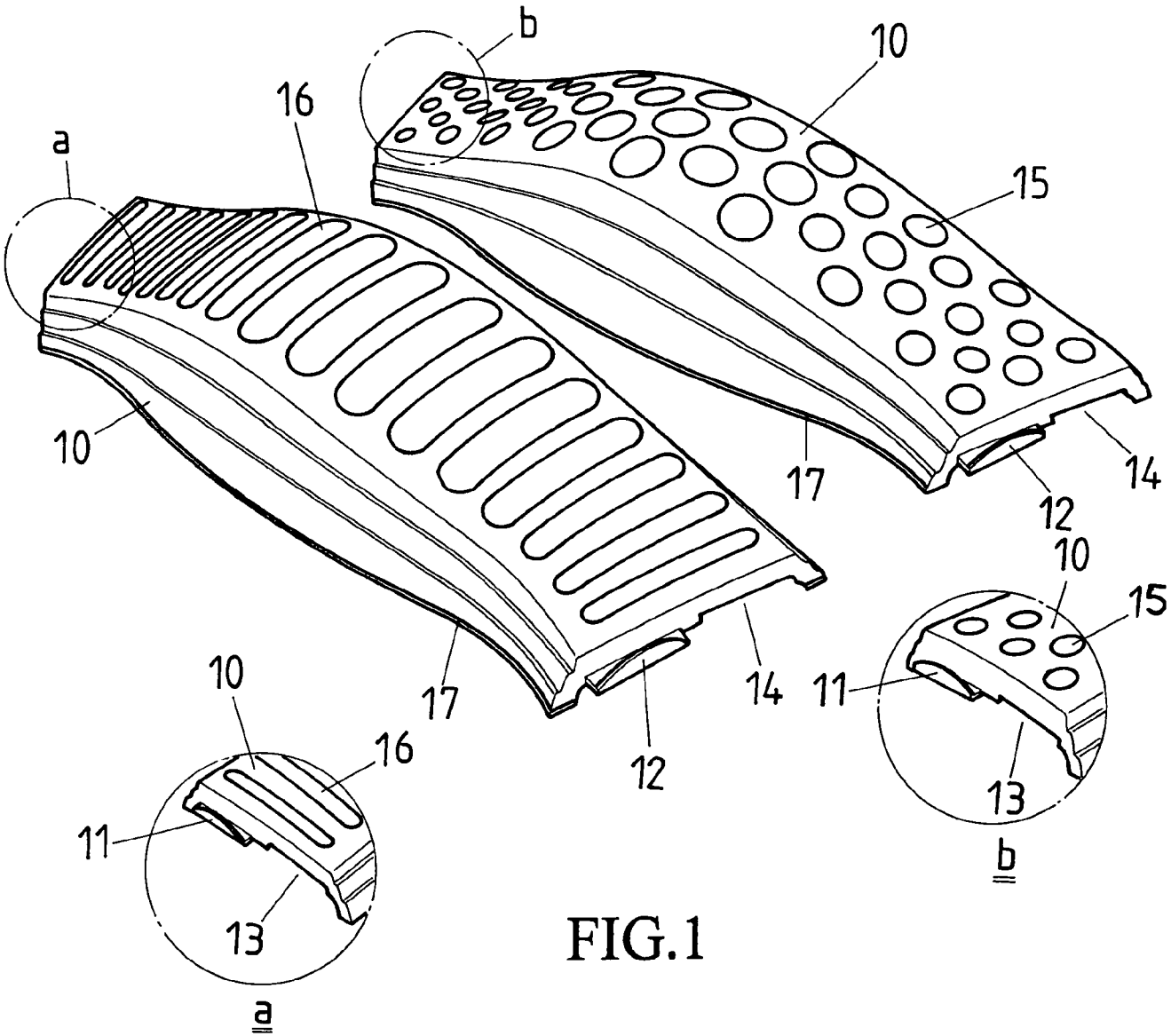
FIG. 1 shows the basic modular unit for the wavy tactile path.

In FIG. 1, a basic modular unit 10 is shown. Two variations are presented herein, with one having anti-skid padding in the shape of straight ridges/grooves 16, and the other having anti-skid padding in the shape of round dots 15.

One embodiment of said modular unit 10 is a three-dimensional arc-shaped block with a central undulation, so that it has a peak height in the center and tapers gently down towards two sides and the two longitudinal ends.

Said modular unit 10 has a slight horizontal bend (light curve) in its longitudinal axis, so that if all such units are connected in the same direction, a circle shape or annular disc will be formed.

At one longitudinal end of said unit 10, there is a connecting tab 12 and a connecting hole 14; at the other longitudinal end of said unit 10, there is a connecting tab 11 and a connecting hole. That way, connecting tab 12 on one modular unit 10 can be securely attached to connecting hole 13 of the next modular unit 10.

Such connection of a multiple unit 10 can be done in any way users desired, to form a round circle or a curvy line, or any shape that fits the interest of children who will walk on such path.

At the bottom side edge of basic modular unit 10, an anti-skid strip 17 is formed, so that the bottom surface of said unit touching the ground has good friction and provides protection against skidding for the units and for a completed walk way.

Figure 2:
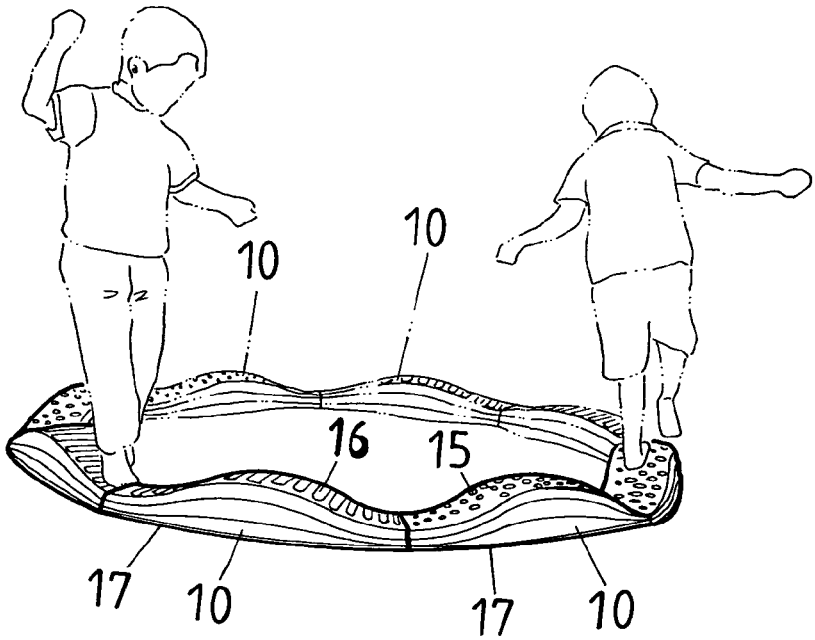
FIG. 2 shows the basic modular units connected into the shape of a circle path.

FIG. 2 shows that a round walk path is formed by connecting basic units 10 in the same orientation.

Figure 3:
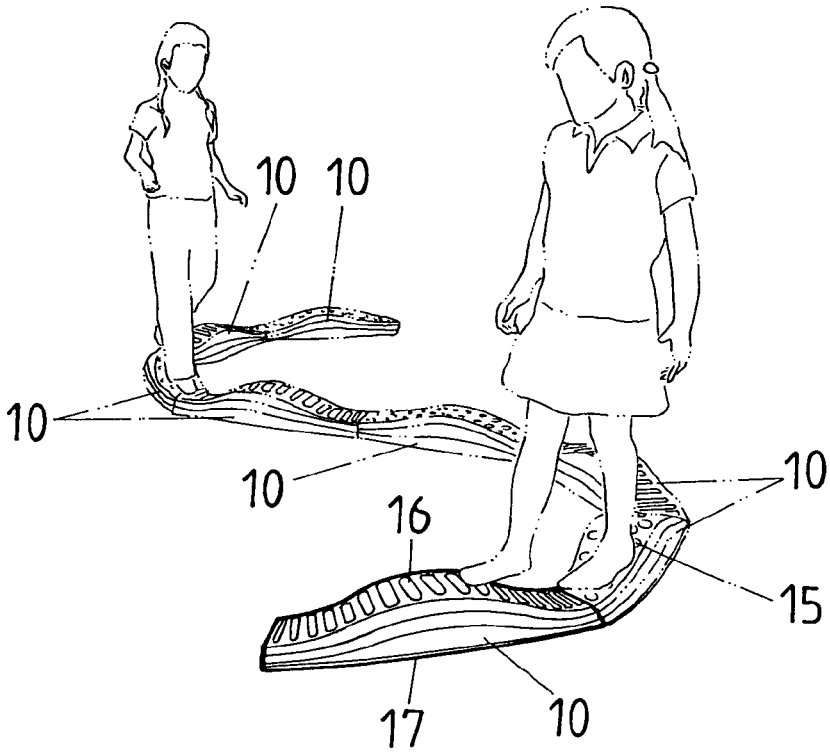
FIG. 3 shows the basic modular units connected into the shape of a curvy line.

FIG. 3 shows a curvy line walk path is formed by connecting basic units 10 in alternating fashion.

Figure 4:
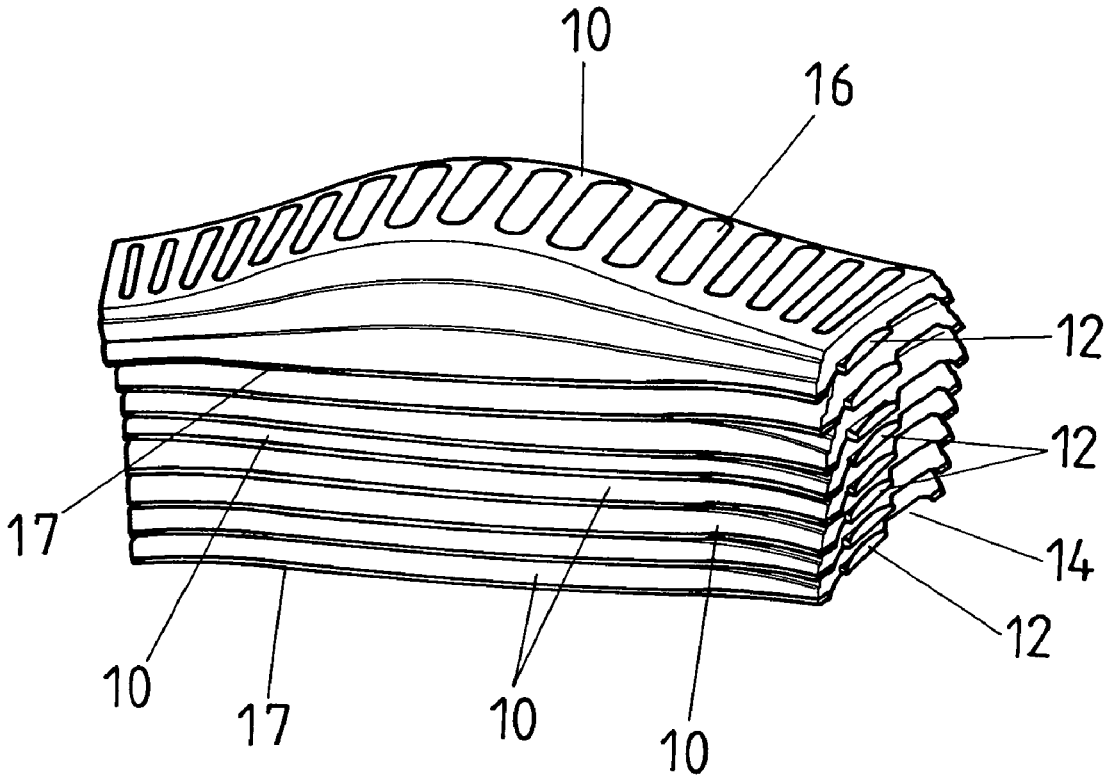
FIG. 4 shows the basic modular units being stacked on top of one another.

FIG. 4 shows that when disassembled, said basic units 10 can be stacked together, resulting in minimum space for a plurality of said unit 10, easy for storage.

Said anti-skid padding can be in the form of ridges/grooves 16, or in the form of dots 15, which can be made to be raised dots or caved in "craters", producing interesting touch sensation for children to walk on with bare feet.

The three-dimensional arc, having peak height in the center of each basic unit 10 provides challenge to children to balance themselves, while they can experience walking on the edge, just before falling, to enjoy the excitement of challenging themselves, without adults worrying that kids will get serious injuries.

What is claimed is:

1. A wavy tactile walk path, comprising:

a plurality of basic units with a generally level anti-skid bottom surface for laying on an area of ground, each basic unit having an upper surface having an elevation with at least one undulation and a light curvature in a horizontal plane along its longitudinal axis, said at least one undulation having a peak height in a middle portion so that it gently tapers laterally down towards the sides and longitudinally towards each respective end with an anti-skid padding on the upper surface; and connectors at each longitudinal of said basic unit so that multiple units can be easily and securely attached together;

wherein said plurality of basic units are connectable end-to-end in a generally circular shape when the basic units are connected with a consistent orientation of radial curvature, and alternatively are connectable in a curvy line when at least one basic unit is connected with an orientation of radial curvature opposing that of at least one nearest neighbor basic unit.

2. The wavy tactile walk path of claim 1, wherein the mating connectors comprise a connecting tab and a connecting hole on each of the two longitudinal ends of said basic units so that the connection between basic units is made by inserting the connecting tab of one basic unit to the connecting hole of a second basic unit.

3. The wavy tactile walk path of claim 2, wherein at least one anti-skip strip is formed on the bottom of the two sides of said basic unit.

4. The wavy tactile walk path of claim 3, wherein the anti-skid padding is in the shape of ridges/grooves in alternating arrangement on top of said basic unit.

5. The wavy tactile walk path of claim 3, wherein the anti-skid padding is in the shape of raised dots spread on top of said basic unit.

6. The wavy tactile walk path of claim 3, wherein the anti-skid padding is in the shape of caved-in dots spread on top of said basic unit.

* * * * *